US005195291A

United States Patent [19]

Pomento

[11] Patent Number: 5,195,291

[45] Date of Patent: Mar. 23, 1993

[54] SPHERICAL WOODEN TRUSS FRAME BUILDING

[76] Inventor: Patrick G. Pomento, 802 W. Embargo St., Rome, N.Y. 13440

[21] Appl. No.: 678,446

[22] Filed: Apr. 1, 1991

[51] Int. Cl.[5] ..... E04B 1/32

[52] U.S. Cl. ..... 52/644

[58] Field of Search ..... 52/80, 90, 639, 640, 52/641, 643, 644, 645, 646, 745

[56] References Cited

U.S. PATENT DOCUMENTS

| | | | |
|---|---|---|---|
| 1,346,229 | 4/1920 | Mecham | 52/639 |
| 2,288,193 | 6/1939 | Horn et al. . | |
| 3,343,321 | 9/1967 | Axelsson . | |
| 3,346,999 | 9/1967 | Johnson . | |
| 3,768,218 | 6/1973 | Blaski . | |
| 3,820,292 | 6/1974 | Fitzpatrick . | |
| 3,894,367 | 7/1975 | Yacoboni . | |
| 3,908,329 | 9/1975 | Walters . | |
| 4,223,506 | 9/1980 | Blair et al. | 52/644 |
| 4,276,733 | 7/1981 | Casper et al. | 52/80 |
| 4,285,174 | 8/1981 | Knight . | |
| 4,393,637 | 7/1983 | Mosier | 52/640 |
| 4,483,117 | 11/1984 | Underhill et al. . | |
| 4,541,210 | 9/1985 | Cook | 52/80 |
| 4,602,461 | 7/1986 | Cummins et al. | 52/639 |
| 4,627,208 | 12/1986 | Esposito . | |
| 4,720,947 | 1/1988 | Yacaboni | 52/80 |
| 4,854,104 | 8/1989 | Pomento . | |
| 4,862,653 | 9/1989 | Pomento . | |

*Primary Examiner*—David A. Scherbel
*Assistant Examiner*—Michele A. Van Patten
*Attorney, Agent, or Firm*—Wall and Roehrig

[57] ABSTRACT

A modular building structure is provided for erection on a circular foundation. The building is formed from a plurality of truss members mounted between the circular foundation and a compression ring at the crown of each truss member. Roof panels fixed to said truss members form a generally spherical building shell for storage of all types of material. The truss members are made in modules or segments that are hinged together for easy erection and simple fastening together to form a unitary rigid box beam structure forming the structural framing of the building. The modular roof panels are formed to mount between adjacent pairs of truss members so as to overlap the truss members and abut each other to form a weather-tight sealed joint and roof structure. The spherical building requires no side wall structure and roofing materials may be used throughout to weather-proof the building.

6 Claims, 4 Drawing Sheets

SPHERICAL WOODEN TRUSS FRAME BUILDING

BACKGROUND OF THE INVENTION

This invention relates to a foldable box beam truss structure and a circular building fabricated therewith having no side wall that can be quickly and easily assembled from premanufactured wooden truss components. More particularly, this invention relates to a spherical building structure that can be completely prefabricated off-site, trucked to the site and assembled to quickly and economically enclose a circular area in a minimum of time.

In my prior U.S. Pat. No. 4,862,653 and in my co-pending application, Ser. No. 07/678,446, I have disclosed circular buildings of this general type. In the cited patent, I have disclosed a combination side wall roof truss arrangement for constructing a circular building and in the referenced co-pending application, I have shown a roof truss arrangement for providing a building structure having a minimum side wall in either the rectangular or circular configuration. These structures have proven very satisfactory for many applications, however, where it is desired to provide a truly spherical building structure, the truss and building construction disclosed herein has been found to be particularly well suited for such a purpose.

SUMMARY OF THE INVENTION

It is therefore an object of the present invention to provide an improved building structure for forming spherical buildings for enclosing a storage space.

It is another object of the present invention to provide a spherical building structure having no side wall surface, but only roof surface.

It is further object of the present invention to provide a roof truss and building structure for erecting a generally spherical structure from premanufactured trusses and roof panels that can be quickly and easily erected on site.

It is still another object of the present invention to provide a simplified premanufactured building structure utilizing roof trusses that can be premanufactured in modules and then hinged together for simplified erection at the building site.

These and other and further objects of the present invention are attained by means of a building structure that is formed from plurality of spaced apart partially arcuate wooden roof truss members mounted on a circular foundation wall at spaced intervals thereabout. Each truss member is made from a pair of truss segments having linear inner chords and arcuate outer chords that are abutted together to form a chordal segment roof truss. Individual truss segments are hinged together at the center of the overall truss member and the base end and the crown end of the assembled truss member also carry hinge members for facilitating mounting on the foundation and erection of the building. The roof trusses, according to the present invention are covered over with a plurality of abutting roof panels mounted to overlap the adjacent trusses and to abut one another to form a smooth outer cylindrical covering of the building structure.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE PREFERRED EMBODIMENT

Figure 1:
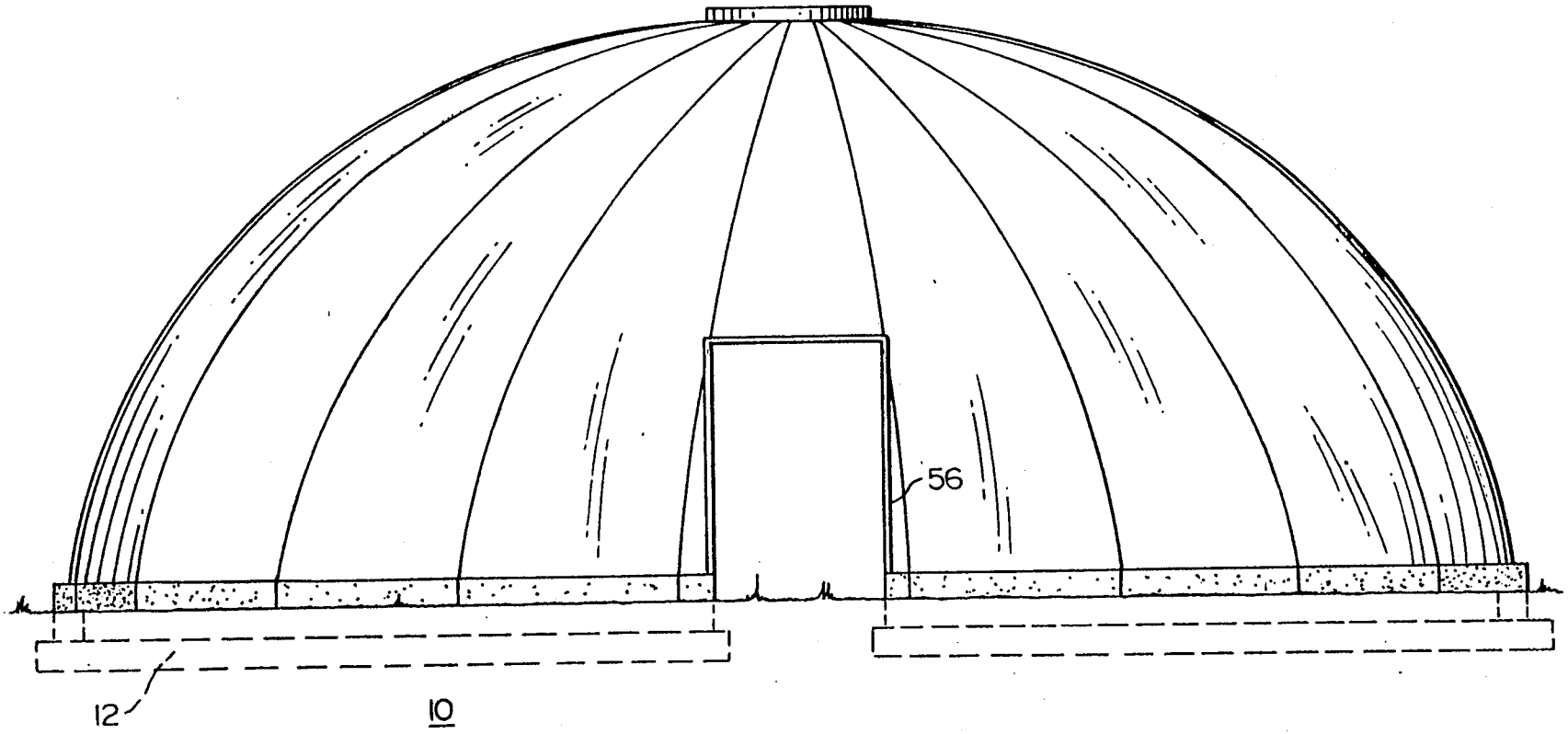
FIG. 1 is a front elevation of a structure according to present invention.
Figure 2:
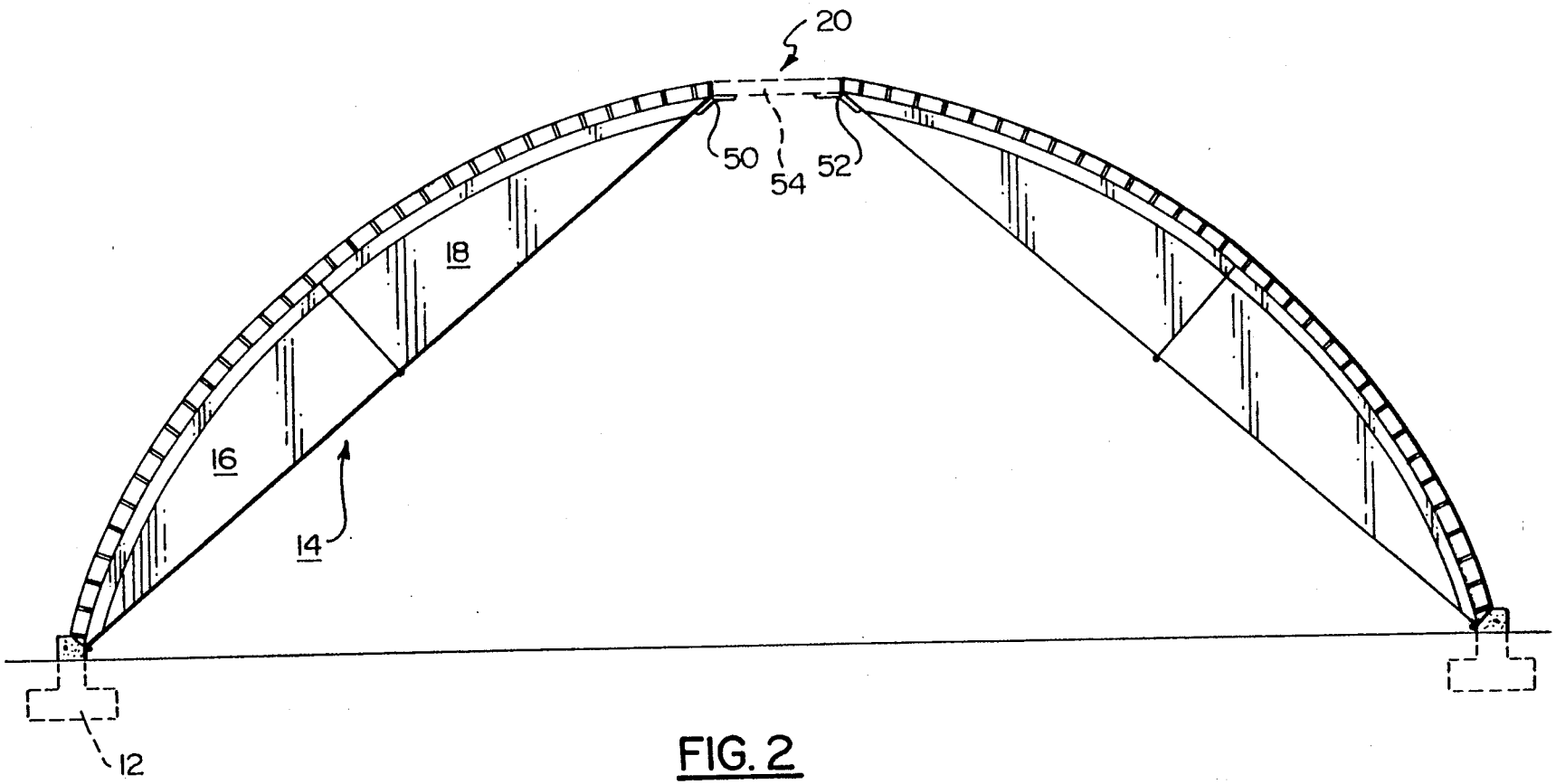
FIG. 2 is a section taken on a diameter of the building of FIG. 1.

Referring now to FIGS. 1 and 2, a building structure 10 embodying the teachings of the present invention includes a circular foundation 12 secured in the ground having a diameter of the desired dimension for the particular building to be erected. The building 10 is formed by mounting a plurality of truss members 14 about the circumference of the circle on the foundation structure 12 in spaced apart relation and joining the crown ends of the trusses 14 together at a compression block 20 to complete the roof structure. Each section of the building is basically on a diameter of the circle and consists of a pair of truss members 14 abutting against the compression block 20 at the crown end and mounted on a suitable mounting pads in the foundation at the base end. Each truss 14 consists of segments 16 and 18 which are essentially mirror images of each other and which are hinged together at the center along the inner linear chord thereof, and which are held together by bolts through the seating stud members 38 38 as will be described in more detail herein.

Figure 4:
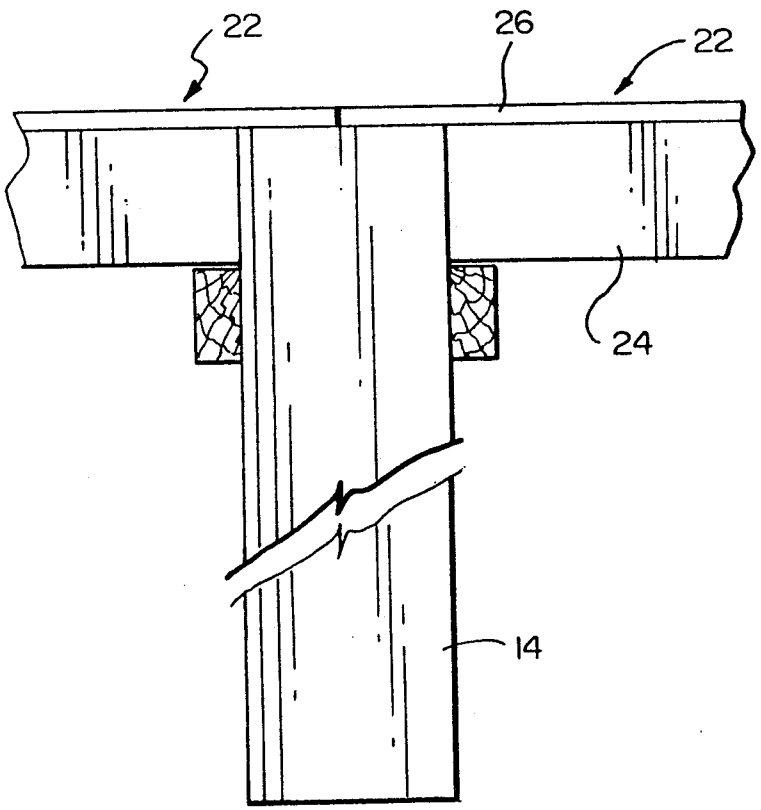
FIG. 4 is a partial sectional view of a pair of roof panel members mounted on either side of a truss member.

To form the building 10 a suitable number of truss members 14 are disposed about the circumference of foundation 12 to meet the particular requirements of the roof loading environment, weather conditions and so forth where the building is to be located. This roof frame structure is then covered over with roof panels 22 which, as may be seen in FIG. 4, consists of a frame of stringers 24 and studs (not shown) which are sized to fit between a pair of adjacent truss members 14. The studs and stringers 24 are covered with a plywood sheathing 26 which extends the length and width of the stringers and studs and also extends over the end of the panel approximately one-half the width of the box beam truss 14 so the adjacent roof panels 22 will abut and can be sealed together along the middle of the truss 14, as shown in FIG. 4.

Each roof panel 22 is sized to fit between truss members 14 at the appropriate level from the ground. Each panel is slightly tapered to match the converging truss angles of the adjacent truss members as the panels proceed from the ground course up to crown.

Figure 3:
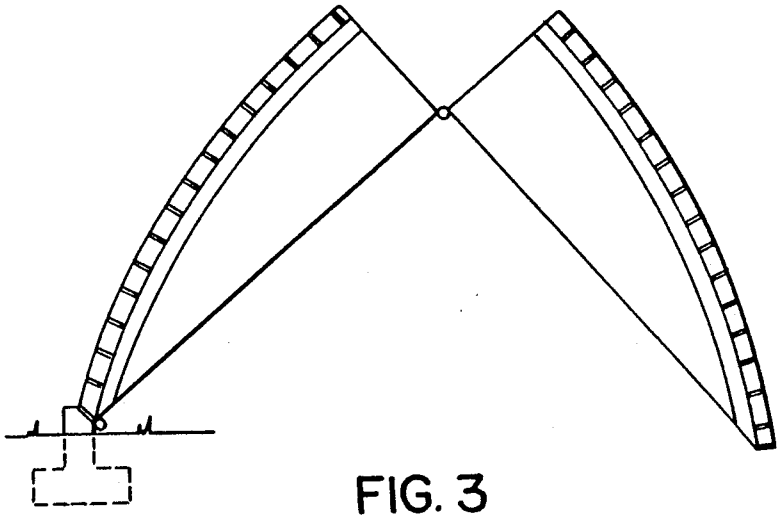
FIG. 3 is a partial section of a truss showing the hinged construction and the truss partially folded open.
Figure 5:
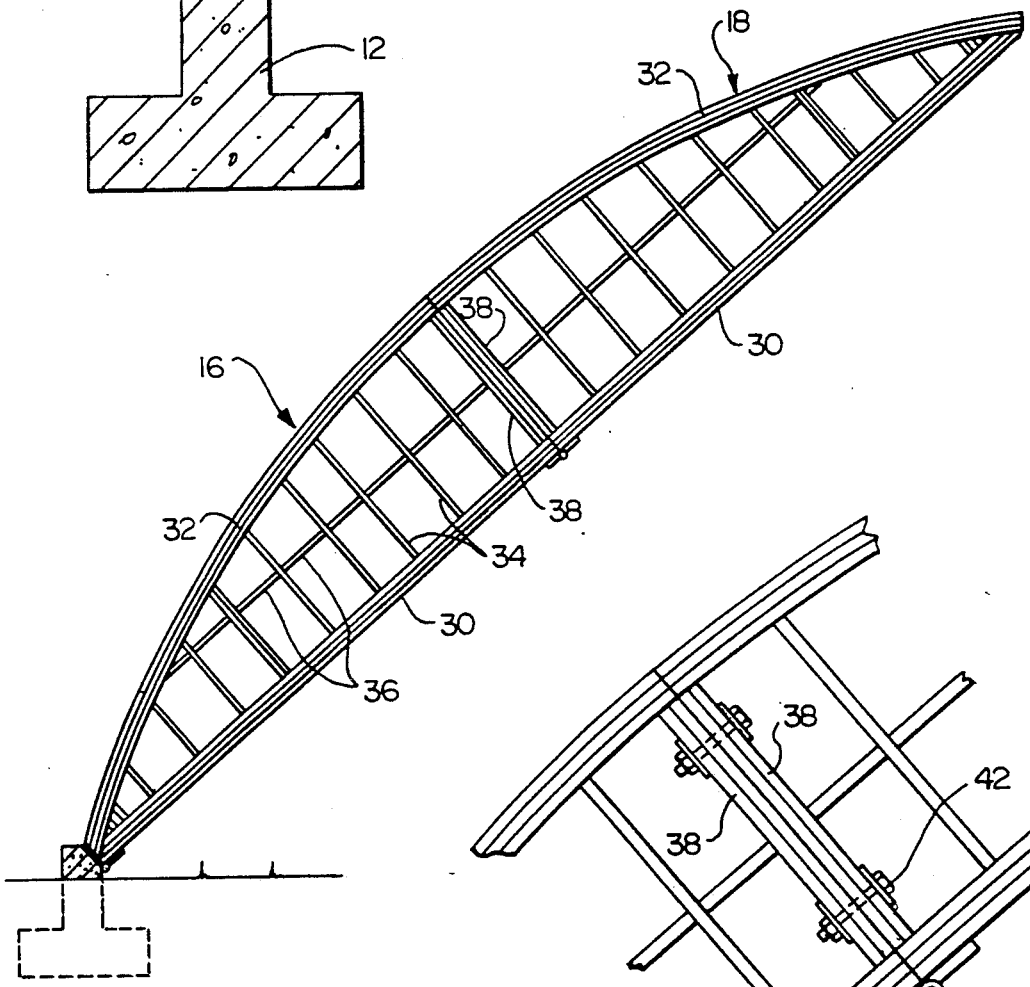
FIG. 5 is a side elevation of an assembled truss member with the side covering panels removed to show the truss construction.
Figure 7:
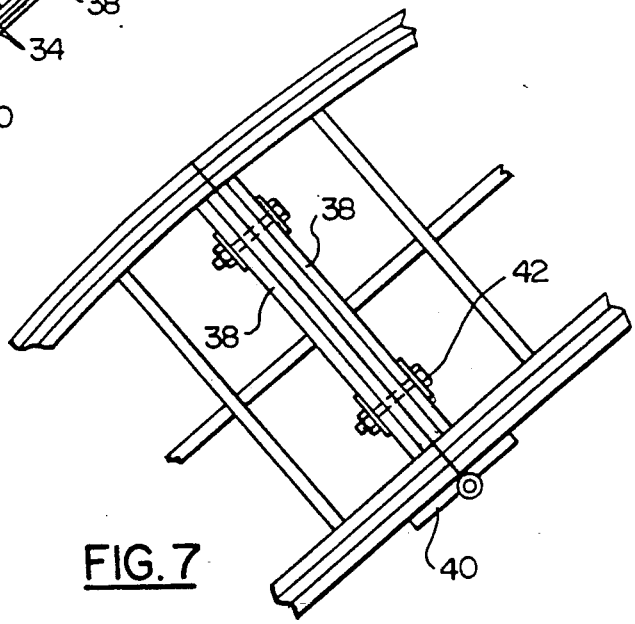
FIG. 7 is a partial detailed elevational view of the bolting together of the end stud members of the truss segments.

As indicated in FIG. 2, each truss 14 is made of two segments 16 and 18 which are essentially mirror images of other. As may be seen in FIGS. 3–5, the truss is hinged at the center of the bottom inner chord of the two segments so that the overall truss can be broken as shown in FIG. 3 to aid in the erection of the truss members. Each truss segment 16 and consists of an inner linear chord member 30, an arcuate chord member 32 and a plurality of studs 34 mounted perpendicular to the inner chord 30 extending between the inner and outer chord. Suitable bridging members 36 are provided at spaced intervals between the studs 34. One end of the inner and outer chord members 30 and 32 are joined together and the other end is fixed to end stud member 38 to fix the spaced apart end of the inner and outer chords in the desired arcuate relationship so that when joined to a mirror image segment 18, a smooth chordal segment of a circle formed. As may be seen in FIG. 7, the two adjacent segments 16 and 18 are hinged together by a hinge 40 which is secured to the inner surface of the inner linear chords 30 and by suitable screws and bolts, not shown. In the assembled condition of FIG. 5, the two end stud members 38 are bolted together by bolts 42 to securely fix the two segments together into a single truss member 14.

Figure 6:
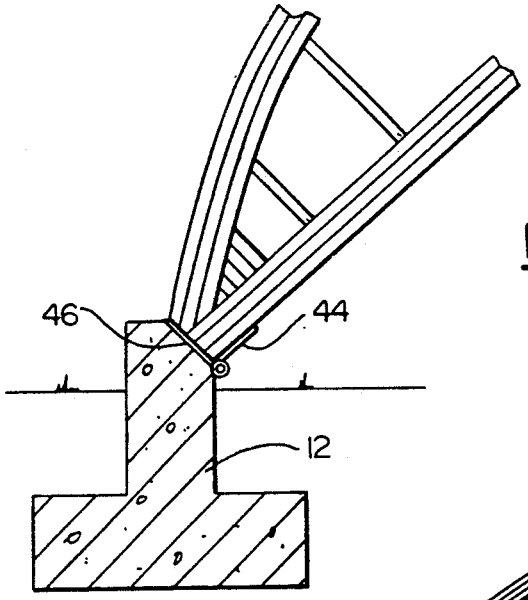
FIG. 6 is a partial section view of the base end of a truss according to the present invention.

As may be seen in FIG. 6, each truss member has at its base end a hinge member 44. One half of hinge member 44 is mouted on the inside of the inner chord member 30 and the other half is secured to a mounting pad 46 on the foundation 12. Suitable lag bolts (not shown) embedded in the concrete of the foundation 12 are used to secure one hinge half thereto. Suitable screws and/or bolts are fixed into the wooden chord members 30 to meet the design loads of the building structure. This hinge 44 assists in the erection of the building in that the truss 14 can be placed essentially on the ground with the base end adjacent the appropriate mounting pad of the foundation and the hinge then secured to the appropriate fastening means in the foundation mounting pad 46. The truss can then simply be raised by using the hinged segments to lift the lower segment into proper position as shown in FIG. 3, which is supported by the upper section until it is desired to raise the upper section to join the compression ring 20 with other similarly mounted truss members.

For transportation the truss segment 16 and 18 can be folded back on one another as suggested in FIG. 3 and the whole unit is thus much shorter and easier to handle for shipment. If the width of the double altitude of the chordal section is too great when hinged together, the hinge can be taken apart and the truss segments piled one on top of the other for shipment, further facilitating shipment by truck and the like from the factory where the segments are manufactured to the site where the building is to be erected.

In some applications it is desirable to hinge the compression ring 20 to the crown end of the truss 14 to facilitate the erection of the various pairs of truss members 14. With this embodiment, the compression ring 20 can be pre-hinged by hinge 50 to one truss member. The first truss member 14 can be held in place with a gin pole and a second truss member 14 can be erected to interface with the compression ring 20 on its opposite diameter via hinge 52 and a hinge pin inserted between the two hinge halves one mounted on the compression ring 20 and the other on the crown end of the second truss member 14. In this way a very simple, quick and easy erection of the building frame can be accomplished. The ring 20 serves as a crown and compression block for the frame structure and has a corresponding series of truss pad mounting faces 54 equal to the number of foundation mounting pad faces 46 so as to provide one for each truss member to be erected to form the building. After all the truss members 14 have been erected, the roof panels 22 are secured in place between the adjacent roof truss members 14 until the building is completely enclosed and sealed against the weather. Suitable roofing materials are then applied in a well known manner and the building is completed as far as the exterior of the structure is concerned.

As may be seen in FIG. 1, a building entrance can be provided between adjacent truss members 14 in any usual manner and as shown in FIG. 1, there is a door frame 56 positioned between adjacent truss members 14 for providing access to the interior of the structure.

Referring again to FIG. 5, the truss structure 14 shown therein has each segment 16 and 18 covered with plywood panels, usually half-inch exterior plywood, which are fastened to the frame members 30–38 by gluing and nailing or screwing to form a unitized rigid box beam structure which when the two segments 16 and 18 are hinged and bolted together, form a continuous rigid and unitized roof truss member 14 for use in constructing the building as described.

It will be seen from the foregoing that the truss structure and the building construction are greatly simplified by the modular construction of truss segments 16 and 18 and the simple easy assembly of same on site to form a building structure. The structure is further enhanced by not having to have any kind of side wall materials and the entire structure can be transported and assembled with minimum crew and equipment in a very short time, making for an economical way to build a storage structure for material of all types.

While this invention has been explained with reference to the structure disclosed herein, it is not confined to the details set forth and this application is intended to cover any modifications and changes as may come within the scope of the following claims:

What is claimed is:

1. A wooden roof truss member, for use in the formation of a partially spherical building, said truss member constructed for mounting at the base end on a foundation support and at the crown end to at least one matching roof truss member to form a roof frame member comprising in combination:

a pair of truss segments joinable in abutting relationship to form a chordal portion of a circle;

each truss segment including a linear inner chord portion and an arcuate outer chord portion;

the inner and outer chord portions being joined together at a first end and spaced apart at a second end a distance equal to the altitude of the circle chord formed by said pair of truss segments;

a seating stud member joining said second ends of said inner and outer chord portions of said pair of truss segments, said seating stud being essentially perpendicular to said inner chord to form a corner therewith, so that the truss segments can be pivoted about the corners to place the seating studs in abutting contact with the arcuate chords of the two truss segments forming a chordal portion of a circle;

hinge means joining the inner chord portions of said truss segments at the corners; and fastening means locking said seating stud members of said truss segments together in abutting contact.

2. A wooden roof truss member according to claim 1 further including a plurality of stud members extending between said inner and outer chord portions at spaced intervals therealong;

a plurality of bridging members positioned at spaced intervals between said stud members;

cover panels enclosing both sides of said truss segments; and means for securing said panels to said chord members, studs and bridging members to form a rigid beam wooden roof truss member.

3. A wooden roof truss member according to claim 2 wherein said stud members are perpendicular to the linear chord portion and said bridging members are parallel thereto.

4. A wooden roof truss member according to claim 3 further including a ledger strip fixed to either side of said outer chord portion a predetermined distance in from the outer surface thereof to form a seat for receiving roof sheathing panels between adjacent roof truss members.

5. A wooden roof truss member according to claim 2 further including hinge means positioned on each inner chord portion at the end joined to the outer chord portion so that said roof truss member may be selectively hinged at a base end to a foundation support and a crown end to matching truss member.

6. A wooden roof truss member according to claim 5 further including a compression member hingedly joined to the crown end of the roof truss member; and said compression member being adapted to be hingedly joined to another corresponding roof truss member at the crown end thereof.

* * * * *